United States Patent [19]

Katoh

[11] Patent Number: 4,755,448

[45] Date of Patent: Jul. 5, 1988

[54] SILVER HALIDE PHOTOGRAPHIC MATERIAL AND METHOD FOR FORMING SUPER HIGH CONTRAST NEGATIVE IMAGES THEREWITH

[75] Inventor: Kazunobu Katoh, Kanagawa, Japan

[73] Assignee: Fuji Photo Film Co., Ltd., Kanagawa, Japan

[21] Appl. No.: 904,062

[22] Filed: Sep. 4, 1986

[30] Foreign Application Priority Data

Sep. 4, 1985 [JP] Japan ..... 60-195655

[51] Int. Cl.[4] ..... G03C 1/34; G03C 5/26

[52] U.S. Cl. ..... 430/266; 430/267; 430/264; 430/444; 430/445; 430/446; 430/448; 430/599; 430/600; 430/603; 430/609; 430/949; 430/564

[58] Field of Search ..... 430/264, 949, 444, 609, 430/564, 590, 600, 603, 265, 266, 267, 445, 446, 448

[56] References Cited

U.S. PATENT DOCUMENTS

| | | | |
|---|---|---|---|
| 4,269,929 | 5/1981 | Nothnagle | 430/264 |
| 4,429,036 | 1/1984 | Hirano et al. | 430/949 |
| 4,447,522 | 5/1984 | Hirano et al. | 430/949 |

*Primary Examiner*—Won H. Louie

*Attorney, Agent, or Firm*—Sughrue, Mion, Zinn, Macpeak, and Seas

[57] ABSTRACT

A negative type silver halide photographic material and a method for forming a super high contrast negative image using the photographic material are disclosed. The photographic material comprises a support, at least one silver halide emulsion layer on the support, and at least one light-insensitive colloid layer on the support, said emulsion layer or light-insensitive hydrophilic colloid layer containing a hydrazine derivative, and further contains the tertiary amine salt of an acid polymer.

12 Claims, No Drawings

SILVER HALIDE PHOTOGRAPHIC MATERIAL AND METHOD FOR FORMING SUPER HIGH CONTRAST NEGATIVE IMAGES THEREWITH

FIELD OF THE INVENTION

The present invention relates to a silver halide photographic material and a method for forming super high contrast negative images using said material. More particularly, it is concerned with a silver halide photographic material for use in the photo-mechanical process and a method for forming super high contrast negative images using said material.

BACKGROUND OF THE INVENTION

In the field of graphic art, a method for forming images exhibiting photographic characteristics such that the contrast is quite high (particularly a gamma value of 10 or more) is needed to ensure good reproduction of images of continuous gradation comprising dot images or good reproduction of line images.

For this method, a special developer called a "lith developer" has heretofore been used. This lith developer contains only hydroquinone as a developing agent, and is greatly decreased in the concentration of free sulfite ions (usually not more than 0.1 mol/liter) by using a sulfurous acid salt as a preservative in the form of a formaldehyde adduct so as not to deteriorate the infectious developing properties of the lith developer. Therefore, the lith developer has a serious disadvantage in that it is quite easily subjected to air oxidation; thus, it cannot be stored for more than 3 days.

To obtain good photographic characteristics such as high contrast, a method of using hydrazine derivatives is known, as described, for example, in U.S. Pat. Nos. 4,224,401, 4,168,977, 4,166,742, 4,311,781, 4,272,606, 4,211,857, 4,243,739, etc. This method permits the formation of images exhibiting photographic characteristics such as super high contrast and high sensitivity, and furthermore, since a high concentration of a sulfurous acid salt can be added to the developer to be used, the stability of the developer against air oxidation is greatly increased as compared with the lith developer.

The above method, however, causes the undesired phenomenon, e.g., formation of black spots due to infections development although it provides high sensitivity and high contrast, and produces a serious problem in the photo-mechanical process. The black spots are formed in non-exposed areas between halftone dots (sometimes called black pepper). This phenomenon becomes particularly conspicuous when the sulfite ion content in a developer is decreased or the pH of a developer increases due to fatigue of the developer which is stored for a long period of time, particularly under high temperature/high humidity condition, and it causes a significant reduction in photographic quality.

Various attempts have hitherto been made in order to eliminate the problem of black spots, but such improvements are frequently accompanied by reduction in sensitivity and gamma value. Thus, no means has been known for solving the problem of black spots without hindering the effect using the above-described hydrazine compounds to increase sensitivity and contrast.

It has been found as described in Japanese Patent Application No. 68873/85 (corresponding to U.S. patent application Ser. No. 846,679 filed on Apr. 1, 1985) that decreasing the pH of a film surface to not more than 5.8 by adding an acidic substance is effective in preventing the formation of black spots. However, it has been found that this method has some disadvantages: for example, (1) a coating solution having a low pH value is unstable as a result of coagulation due to the mutual action of gelatin or an acid polymer, (2) the coating layer is inhibited in gelatin hardening, and (3) the sensitivity is reduced.

SUMMARY OF THE INVENTION

An object of the present invention is to provide a silver halide photographic material which forms an image exhibiting photographic characteristics such that the sensitivity and contrast are high to such an extent that the gamma is in excess of 10, and that the formation of black spots is markedly reduced, even when developed with a stable developer.

Another object of the present invention is to provide an image-forming method using the above silver halide photographic material.

It has been found that the object can be attained by incorporating an acid polymer tertiary amine salt in a negative type silver halide photographic material comprising a support, at least one silver halide emulsion layer on the support, and at least one light-insensitive hydrophilic colloid layer on the support, said emulsion layer or light-insensitive hydrophilic colloid layer containing a hydrazine derivative, and by developing the above silver halide photographic material, after imagewise exposure, with a developer containing at least 0.15 mol/liter of sulfite ion and having a pH of from 10.5 to 12.3.

In one aspect, therefore, the present invention is directed to a negative type silver halide photographic material comprising a support, at least one silver halide emulsion layer on the support, and at least one light-insensitive hydrophilic colloid layer on the support, said emulsion layer or light-insensitive hydrophilic colloid layer containing a hydrazine derivative, and further containing a tertiary amine salt of an acid polymer.

In another aspect, the present invention is directed to a method for forming a super high contrast image which comprises imagewise exposing a negative type silver halide photographic material comprising a support, at least one silver halide emulsion layer on the support, and at least one light-insensitive colloid layer on the support, wherein said emulsion layer or light-insensitive hydrophilic colloid layer contains a hydrazine derivative, and further contains a tertiary amine salt of an acid polymer, and then developing the photographic material with a developer containing at least 0.15 mol/liter of sulfite ion and having a pH of from 10.5 to 12.3.

DETAILED DESCRIPTION OF THE INVENTION

Hydazine derivatives which can be used in the present invention include hydrazine derivatives having a sulfinyl group as described in U.S. Pat. No. 4,478,928 and compounds represented by formula (I):

$$R_1\text{—NHNH—CHO} \qquad \text{(I)}$$

wherein $R_1$ is an aliphatic, aromatic, or heterocyclic group.

The aliphatic group represented by $R_1$ in formula (I) preferably has from 1 to 30 carbon atoms and is particularly preferably a straight, branched, or cyclic alkyl group having from 1 to 20 carbon atoms. This branched alkyl group may be cyclized so as to form a saturated hetero ring containing one or more hetero atoms therein. The alkyl group may be substituted with groups such as an aryl group, an alkoxy group, a sulfoxy group, a sulfonamide group, and a carbonamide group.

Typical examples include a tert-butyl group, an n-octyl group, a tert-octyl group, a cyclohexyl group, a pyrrolydyl group, an imidazolyl group, a tetrahydrofuryl group, and a morpholino group.

The aromatic or heterocyclic group represented by $R_1$ in formula (I) is preferably a monocyclic or dicyclic aryl group, or an unsaturated hetero ring group. The unsaturated hetero ring group may condense with a monocyclic or dicyclic aryl group to form a heteroaryl group.

Typical examples include a benzene ring, a naphthalene ring, a pyridine ring, a pyrimidine ring, an imidazole ring, a pyrrazole ring, a quinoline ring, an isoquinoline ring, a benzimidazole ring, a thiazole ring, and a benzothiazole ring. Of these compounds, those containing a benzene ring are preferred.

A particularly preferred example represented by $R_1$ in formula (I) is an aryl group.

The aryl group, or aromatic or heterocyclic group represented by $R_1$ may have one or more substituents.

Typical examples of substituents include a straight, branched, or cyclic alkyl group (preferably having from 1 to 20 carbon atoms), an aralkyl group (preferably a monocyclic or dicyclic group in which the alkyl portion has from 1 to 3 carbon atoms), an alkoxy group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms). A particularly preferred example of substituents is an acylamino group or a ureido group.

In $R_1$ of formula (I) may be incorporated a ballast group which is commonly used in immobile photographic additives such as couplers. The ballast group is a group having at least 8 carbon atoms and is relatively inert to photographic properties. The ballast group can be chosen from an alkyl group, an alkoxy group, a phenyl group, an alkylphenyl group, a phenoxy group, an alkylphenoxy group, and the like.

In $R_1$ of formula (I) may be incorporated a group capable of increasing adsorption onto the silver halide particle surface. Such adsorption groups include a thiourea group, a heterocyclic thioamide group, a mercapto heterocyclic group, a triazole group, and the like as described in U.S. Pat. No. 4,385,108.

Methods of synthesizing these compounds are described, for example, in U.S. Pat. Nos. 4,168,977, 4,224,401, 4,171,977, and 4,323,643.

In the present invention, when the hydrazine derivatives are incorporated in the photographic light-sensitive material, it is preferred that the hydrazine derivatives be incorporated in a silver halide emulsion layer. The hydrazine derivatives may be incorporated in a light-insensitive hydrophilic colloid layers (e.g., a protective layer, an interlayer, a filter layer, and an antihalation layer) other than the silver halide emulsion layer. When the hydrazine derivatives are water-soluble, it is added to a hydrophilic colloid solution in the form of an aqueous solution, and when sparingly soluble in water, it is added to a hydrophilic colloid solution in the form of a solution using an organic solvent miscible with water, such as alcohols, esters, and ketones. When the hydrazine derivatives are added to a silver halide emulsion layer, it may be added at any desired stage from the start of chemical ripening to coating, but it is preferably added during the period from the finish of the chemical ripening to the coating. It is particularly preferred that the hydrazine derivatives be added to a coating solution prepared for coating.

The optimum amount of the hydrazine derivatives to be added can be easily determined by one skilled in the art although it varies with factors such as the grain size, the halogen composition, and method and extent of chemical sensitization of a silver halide emulsion, the relation between a layer in which the hydrazine derivatives are to be incorporated and the silver halide emulsion layer, the type of anti-foggant, and so forth. Usually, the compound is used preferably in an amount of from $1\times10^{-6}$ to $1\times10^{-1}$ mol per mol of silver halide, and particularly preferably in an amount of from $1\times10^{-5}$ to $4\times10^{-2}$ mol per mol of silver halide.

Representative examples of the compounds represented by formula (I) are shown below, although the present invention is not limited thereto.

I-1

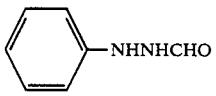

I-2

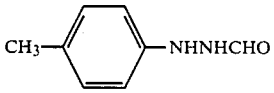

I-3

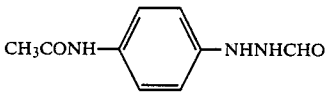

I-4

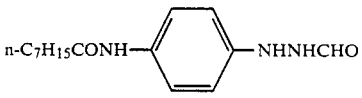

I-5

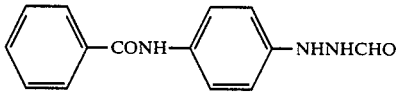

I-6

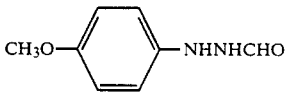

I-7

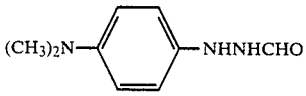

I-8

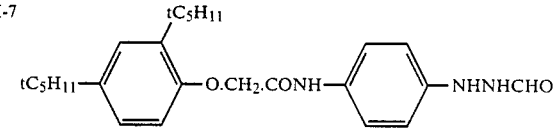

-continued
I-9
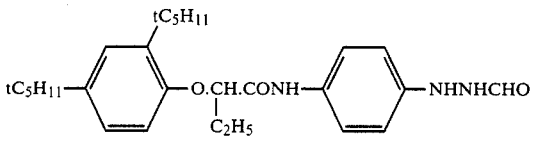
I-10
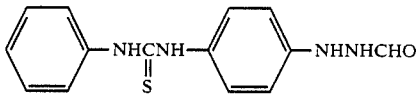
I-11
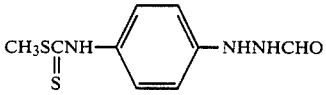
I-12
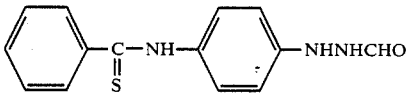
I-13
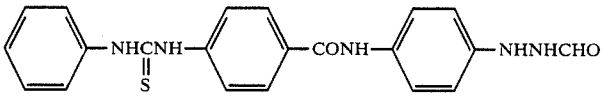
I-14
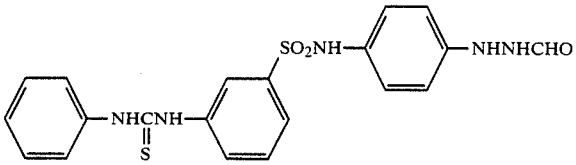
I-15
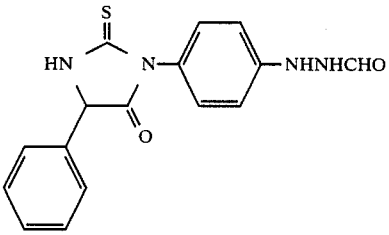
I-16
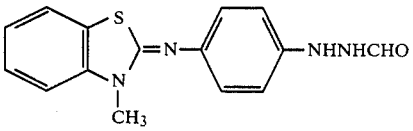
I-17
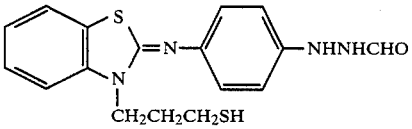
I-18
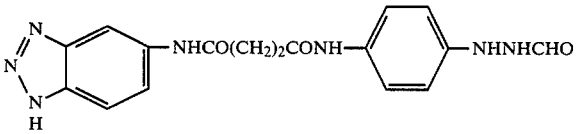
I-19
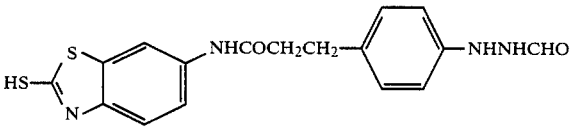
I-20
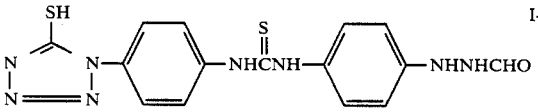
I-21
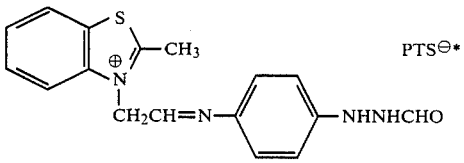
I-22
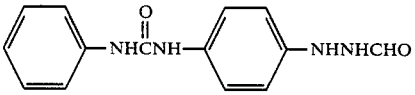
I-23
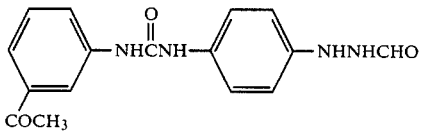

-continued
I-24
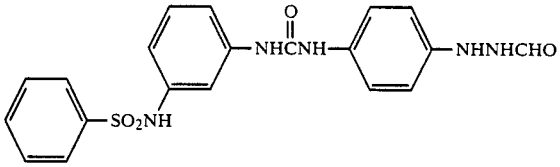
I-25
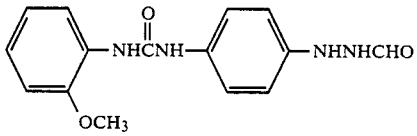
I-26
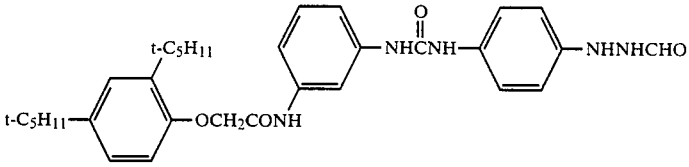
I-27
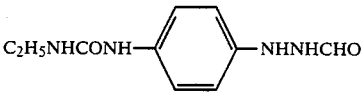
I-28
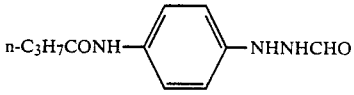
I-29
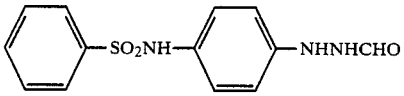
I-30
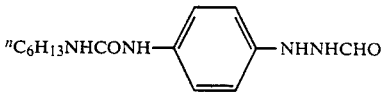
I-31
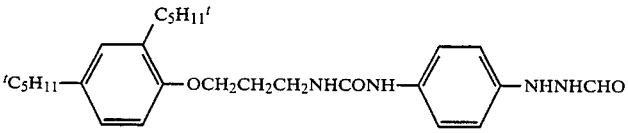
I-32
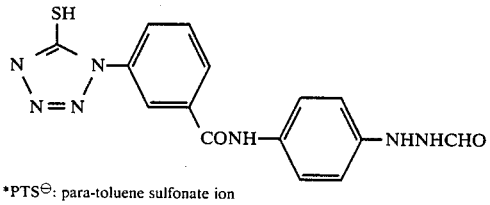
I-33
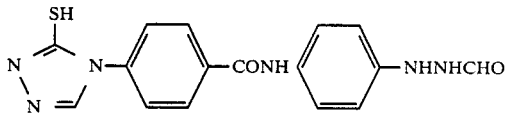
*PTS$^{\ominus}$: para-toluene sulfonate ion
In addition, compounds represented by the following formulae as described in U.S. Pat. No. 4,478,928 can also be used.
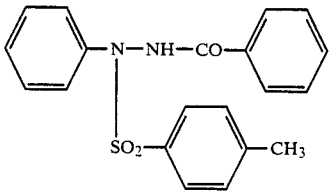
-continued
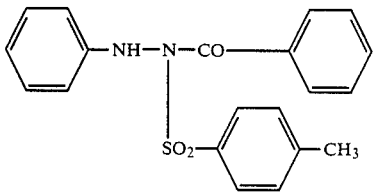
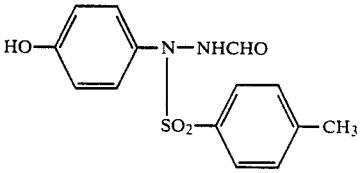
Acid polymers which are used in the present invention are generally compounds containing an acidic group having the pKa value of not more than 9, preferably polymers having a carboxyl group, a sulfoxyl group, or an enediol group. Examples of the acid polymers include acrylic acid, methacrylic acid, or maleic acid polymers and their partial esters or acid anhydrides as described in U.S. Pat. No. 3,362,819; acrylic acid-acrylic acid ester copolymers as described in French Pat. No. 2,290,699; and latex-type acid polymers as described in U.S. Pat. No. 4,139,383 and *Research Disclosure* RD No. 16102 (September, 1977).

In addition, acid polymers as described in U.S. Pat. No. 4,088,493, Japanese Patent Application (OPI) Nos. 1023/78, 4540/78, and 4542/78, (the term "OPI" as used herein means a "published unexamined patent application"), and U.S. Pat. Nos. 4,149,890 and 4,149,891, and so forth can be used.

More preferred among the acid polymers are compounds represented by formulae (IIa) and (IIb)

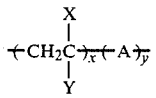

(IIa)

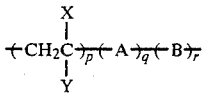

(IIb)

In the above formulae, X represents a hydrogen atom, a halogen atom, a cyano group, or a substituted or unsubstituted alkyl group.

Y represents a hydrogen atom, a haogen atom, a cyano group, a substituted or unsubstituted alkyl group, a group

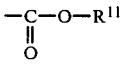

(wherein $R^{11}$ represents a substituted or unsubstituted alkyl group having 2 or more carbon atoms, or a substituted or unsubstituted aryl group), a group

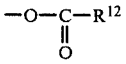

(wherein $R^{12}$ represents a substituted or unsubstituted alkyl group, or a substituted or unsubstituted aryl group), a group

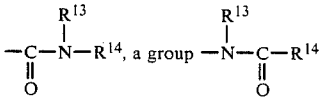

(wherein $R^{13}$ and $R^{14}$ each represents a hydrogen atom, a substituted or unsubstituted alkyl group, or a substituted or unsubstituted aryl group (and may be the same or different)), or a substituted or unsubstituted aryl group.

A represents a repeating unit (monomer unit) derived from an ethylenically unsaturated monocarboxylic acid or monocarboxylic acid salt capable of copolymerizing with an ethylenically unsaturated monomer.

B represents a polyfunctional crosslinking agent.

x, y, p, q, and r each represents the mol percentage of the respective components with which they are associated in formulae (IIa) and (IIb) and have the following relationship:

$x+y=100$, $0 \leqq x \leqq 60$, $40 \leqq y \leqq 100$,
$p+q+4+R=100$, $0 \leqq p \leqq 60$, $30 \leqq q \leqq 100$,
$0 \leqq r \leqq 40$.

Examples of the substituents for the above substituted alkyl group and substituted aryl group include a hydroxyl group, a halogen atom (preferably a chlorine atom), a cyano group, an alkyl group, and an aryl group.

Preferred compounds among those represented by formulae (IIa) and (IIb) are those compounds in which X represents a hydrogen atom, or a substituted or unsubstituted alkyl group in which the alkyl residue has from 1 to 4 carbon atoms, and Y represents a group

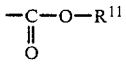

(wherein $R^{11}$ represents a substituted or unsubstituted alkyl group in which the alkyl residue has from 2 to 12 carbon atoms), a group

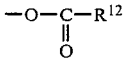

(wherein $R^{12}$ represents a substituted or unsubstituted alkyl group having from 1 to 12 carbon atoms), a group

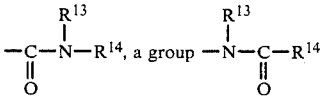

(wherein $R^{13}$ and $R^{14}$ each represents a hydrogen atom, or a substituted or unsubstituted alkyl group having from 1 to 12 carbon atoms (and may be the same or different)), and a styrene group.

In connection with the mol percentage of the monomer components, in the case of formula (IIa), y is preferably from 60 to 99, and more preferably from 70 to 90, and in the case of formula (IIb), r and q are preferably from 5 to 35 and 40 to 95, respectively, and more preferably from 10 to 30 and 50 to 80, respectively.

Particularly preferred among the groups represented by Y are a group

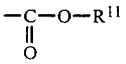

(wherein $R^{11}$ is a substituted or unsubstituted alkyl group in which the alkyl residue has from 2 to 6 carbon atoms and more preferably from 3 to 5 carbon atoms), and a group

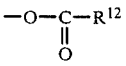

(wherein $R^{12}$ is a substituted or unsubstituted alkyl group in which the alkyl residue has from 1 to 6 carbon atoms).

Monomers providing the component (repeating unit) A represent monomers represented by formula (III):

$$CH_2{=}CH{-}COOR^{15} \qquad \text{(III)}$$

wherein $R^{15}$ represents a hydrogen atom, a group $$-R^{16}-O-\underset{\underset{O}{\|}}{C}-R^{17}-COOH$$

and a group $-R^{16}-O-R^{18}-COOH$ (wherein $R^{16}$ and $R^{17}$ may be the same or different and each represents an alkylene group (preferably having from 2 to 4 carbon atoms and more preferably an ethylene group), and $R^{18}$ represents an alkylene group or an arylene group (preferably a phenylene group) as described above; they may be further substituted with the substituents of the substituted alkyl group and substituted aryl group as are defined for formula (IIa) and (IIb) as described above).

Representative examples of the monomers represented by formula (III) are shown in the form of a free acid.

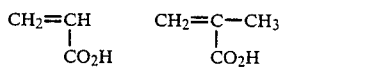

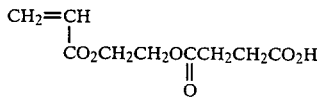

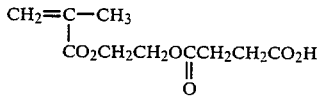

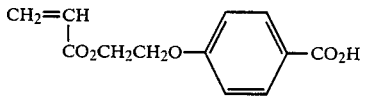

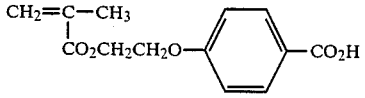

Of the above monomers, acrylic acid and methacrylic acid are particularly preferred.

The component B is a polyfunctional crosslinking agent. Examples of the component B include substantially water-insoluble divinylbenzene, trivinylcyclohexane, trivinylbenzene, or 2,3,5,6-tetrachloro-1,4-dinvinylbenzene; esters of unsaturated acids and unsaturated alcohols, such as vinyl crotonate; allyl methacrylate, and allyl crotonate; esters of unsaturated acids and polyfunctional alcohols, such as trimethylolpropane trimethacrylate, neopentyl glycol dimethacrylate, butanediol dimethacrylate, 1,6-hexanediol diacrylate, 1,5-pentanediol diacrylate, pentaerithritol triacrylate, tetraethylene glycol diacrylate, and triethylene glycol diacrylate; esters of unsaturated alcohols and polyfunctional acids, such as diethyl phthalate; unsaturated polyethers such as triethylene glycol divinyl ether; water-soluble bisacrylamides such as methylene bisacrylamide, glyoxal bisacrylamide, N,N'-dihydroxyethylene bisacrylamide, N,N'-cisamine bisacrylamide, and triacryl diethylenetriamine; and acrylic acid (or methacrylic acid) esters of polyethers, such as polyethylene glycol diacrylate (or dimethacrylate), and divinylsulfone.

Particularly preferred as the component B are divinyl benzene and diethylene glycol dimethacrylate.

The copolymers represented by formula (IIa) or (IIb) may include other known copolymerizable monomer components such as maleic acid, maleic anhydride, N-vinyl pyrrolidone, N-vinylimidazole, and monomers as described in U.S. Pat. No. 4,438,278.

The acid polymers represented by formula (IIa) are suitable for use as a solution in water or an organic solvent such as methanol, ethanol, acetone, methyl ethyl ketone, cellosolve, diacetone alcohol, and toluene, which are good solvents for the polymers.

The acid polymers represented by formula (IIb) are suitable for use in the form of a latex which is prepared by the emulsion polymerization method or suspension polymerization method, and in which fine grains are dispersed in water.

Representative examples of the copolymers represented by formulae (IIa) and (IIb) are shown below (the copolymerization ratio in the compounds is shown in terms of mol percent).

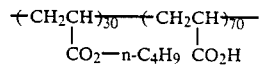

II-1

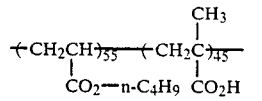

II-2

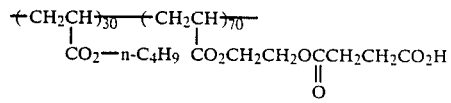

II-3

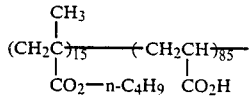

II-4

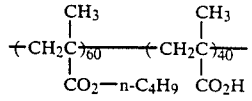

II-5

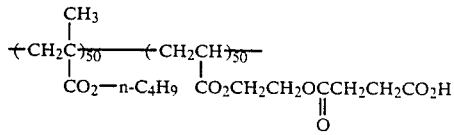

II-6

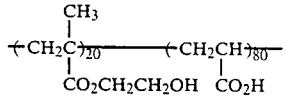

II-7

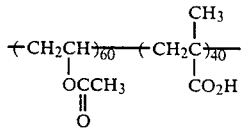

II-8

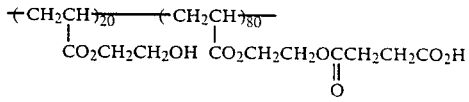

II-9

-continued

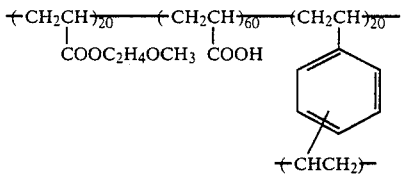

II-10

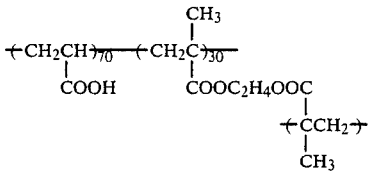

II-11

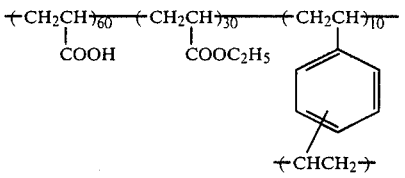

II-12

Preferred as the acid polymer are polymers containing acrylic acid as an acid group. As the monomer component to be copolymerized with acrylic acid, alkyl acrylate, and alkyl methacrylate are preferred.

Preferably, the acid polymers are in the form of a latex dispersed in water and can be easily mixed with water-soluble binders such as gelatin, polyacrylamide, and polyvinyl alcohol without causing problems of coagulation and precipitation.

Tertiary amines which are used in the present invention are compounds represented by formula (IV)

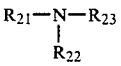

(IV)

In the above formula, $R_{21}$, $R_{22}$, and $R_{23}$ (which may be the same or different) are each selected from the following groups:

(1) an alkyl group having 6 or less carbon atoms;

(2) a substituted alkyl group (examples of the substituent include a hydroxyl group (—OH), a phenyl group, an alkoxy group (having 6 or less carbon atoms), an alkylamido group (having 6 or less carbon atoms), a sulfonamido group, and an alkoxyamido group (having 6 or less carbon atoms));

(3) an aryl group having from 6 to 12 carbon atoms;

(4) a substituted aryl group (examples of the substituent include a hydroxyl group (—OH), an alkyl group (having 6 or less carbon atoms), a hydroxyalkyl group (having 6 or less carbon atoms), an alkoxy group (having 6 or less carbon atoms), an alkylamido group (having 6 or less carbon atoms), a sulfonamido group, and an alkoxyamido group (having 6 or less carbon atoms)); and (5) a 5- or 6-membered ring formed by N and two of $R_{21}$, $R_{22}$, and $R_{23}$.

The 5- or 6-membered ring may be a saturated or unsaturated and may have a substituent or substituents the same as those described as substituents for the above described substituted alkyl groups and substituted aryl groups of formula (IV). Examples of such 5- and 6-membered rings include a morpholine ring, a pyrrolidine ring, a piperidine ring, a piperadine ring, an imidazoline ring, pyrazoline ring, and an indoline ring.

Preferred examples of $R_{21}$, $R_{22}$, and $R_{23}$ in formula (IV) are groups indicated by (2), (4), and (5). Particularly preferred examples of $R_{21}$, $R_{22}$, and $R_{23}$ are groups indicated by (2) and (5).

Representative examples of the compounds represented by formula (IV) are shown below.

$N(C_2H_4OH)_3$ N-1

$(CH_3)_2NCH_2CH(OH).CH_2OH$ N-2

$C_2H_5N(C_2H_4OH)_2$ N-3

N-4

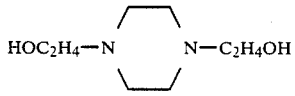

$[(CH_3)_2CH]_2N.C_2H_4OH$ N-5

N-6

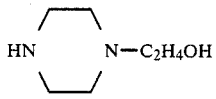

$(CH_3)_2NCH_2CH(OH).CH_3$ N-7

$n\text{-}C_4H_9N(C_2H_4OH)_2$ N-8

$(CH_3)_3N$ N-9

$(C_2H_5)_2NC_2H_4OC_2H_4OH$ N-10

$C_6H_5N(C_2H_4OH)_2$ N-11

$(CH_3)_2NC_2H_4OH$ N-12

N-13

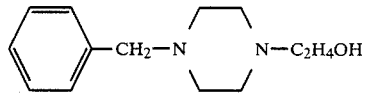

$CH_3N(C_2H_4OH)_2$ N-14

$(C_2H_5)_3N$ N-15

N-16

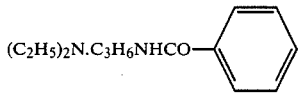

$(CH_3)_2NC_3H_6NHCOO—C_4H_9$ N-17

N-18

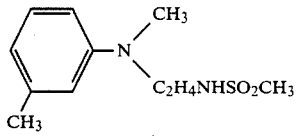

N-19

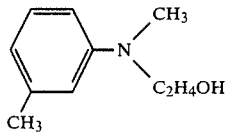

N-20

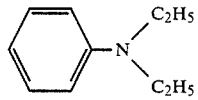

N-21

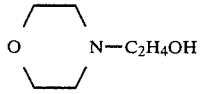

Some tertiary amines represented by formula (IV) accelerate a contrast-increasing action when used in combination with hydrazines. In the present invention, tertiary amines represented by formula (IV) having no influence on the contrast-increasing action of hydrazine derivatives are preferably used.

Particularly preferred are tertiary amines of formula (IV) wherein at least one of $R_{21}$, $R_{22}$, and $R_{23}$ represents a hydroxyethyl group.

Acid polymer/tertiary amine salts of the present invention can be prepared by dissolving or dispersing the acid polymer and the tertiary amine in water or a suitable organic solvent compatible with water, or a mixture thereof, and then mixing them.

If desired, the salt may be prepared by successively adding the above solutions or dispersions to a light-sensitive emulsion coating solution. In view of the problem of coagulation of gelatin, it is preferred that the salt be previously prepared and then added.

It is preferred for the tertiary amine to be used in an amount required to neutralize from 10 to 100 mol%, and more preferably from 20 to 80 mol%, of the acidic groups of the acid polymer.

In the present invention, when the acid polymer/tertiary amine salt is incorporated in a photographic light-sensitive material, it can be incorporated in a silver halide emulsion layer or a light-insensitive hydrophilic colloid layer other than the emulsion layer. Preferred layers for the incorporation of the acid polymer/tertiary amine salt are a light-insensitive hydrophilic colloid layer adjacent to an emulsion layer.

In connection with the amount of the acid polymer/-tertiary amine salt of the present invention being coated, it is desirable for the optimum amount to be determined depending on the acid content of the polymer, processing conditions, amounts of various additives added and so forth. The amount of the acid polymer/tertiary amine salt is preferably from 10 mg/m$^2$ to 10 g/m$^2$, and more preferably from 20 mg/m$^2$ to 3 g/m$^2$. The amount of the acidic groups is preferably from 0.1 mmol/m$^2$ to 100 mmol/m$^2$, and preferably from 0.5 mmol/m$^2$ to 50 mmol/m$^2$.

The pH of the surface layer of the silver halide light-sensitive material containing the acid polymer/tertiary amine salt of the present invention is generally in the range of from 5.0 to 6.8, and preferably from 5.4 to 6.4.

As silver halide for the silver halide emulsion used in the present invention, any of silver chloride, silver chlorobromide, silver iodobromide, silver iodochlorobromide, and the like can be used. Silver halide comprising at least 70 mol%, particularly at least 90 mol% of silver bromide is preferred. The silver iodide content is preferably not more than 10 mol%, and particularly preferably from 0.1 to 5 mol%.

The average grain size of silver halide used in the present invention is preferably not more than 0.7 $\mu$m, and particularly preferably not more than 0.5 $\mu$m. Although there are no limitations to the grain size distribution, it is preferred to use monodisperse silver halide grain. The term "monodisperse silver halide grain" as used herein means that at least 95% of the silver halide grains as determined based on either weight or a number of grains, have a grain size falling within the range of the average grain size $\pm$40%.

Silver halide grains in the photographic emulsion may have a regular form crystal, such as a cubic or an octahedral form, or an irregular form crystal, such as a spherical or a tabular form, or a composite form crystal thereof.

The silver halide grains may have a homogeneous phase or a heterogeneous phase through the surface layer to the interior thereof. Two or more different silver halide emulsions separately prepared may be used as a mixture.

In the formation of silver halide grains or the process of the physical ripening thereof, a cadmium salt, a sulfurous acid salt, a lead salt, a thallium salt, a rhodium salt, or a complex salt thereof, an iridium salt or a complex salt thereof, etc. may be present in the silver halide emulsion as described in G. F. Duffin, *Photographic Emulsion Chemistry,* The Focal Press, (1966).

A silver halide emulsion that is particularly preferable for the present invention is prepared in the presence of an iridium salt or a complex salt thereof in an amount of from $1\times10^{-8}$ to $1\times10^{-5}$ mol per mol of silver and has a larger silver iodide content in the surace of each grain than the average throughout the whole of each individual grain. Use of an emulsion containing such a silver haloiodide results in higher sensitivity and increased gamma.

The iridium salt of the above-specified amount is desirably added to the silver halide emulsion before the completion of physical ripening, particularly during the grain formation.

Iridium salts which can be used in the present invention include water-soluble iridium salts or iridium complex salts, such as iridium trichloride, iridium tetrachloride, potassium hexachloroiridate (III), potassium hexachloroiridate (IV), ammonium hexachloroiridate (III), etc.

Binders or protective colloids for photographic emulsions include gelatin to advantage, but other hydrophilic colloids may also be employed. Examples of useful hydrophilic colloids include proteins, such as gelatin derivatives, graft polymers of gelatin with other polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; and a large variety of synthetic hydrophilic polymers, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., and copolymers comprising monomers constituting these homopolymers.

Gelatins to be used in the present invention include lime-processed gelatin, acid-processed gelatin, and, in addition, gelatin hydrolyzates or enzymatic decomposition products of gelatin.

The silver halide emulsion which is used in the present invention may (or may not) be subjected to chemical sensitization. Chemical sensitization can be carried out by sulfur sensitization, reduction sensitization, noble metal sensitization, or a combination thereof. These methods are described in H. Frieser ed., *Die Grundlagen der Photographisischen Prozesse mit Silberhalogeniden,* Adamedische Verlagsgesellschaft (1968).

Gold sensitization, which is a typical example of noble metal sensitization, employs a gold compound, mainly a complex salt thereof. Complex salts of noble metals other than gold, such as platinum, palladium, iridium, etc., can be incorporated. Specific examples thereof are described in U.S. Pat. No. 2,448,060, British Pat. No. 618,061, and so on.

Sulfur sensitizing agents which can be used include as well as sulfur compounds contained in gelatin, various sulfur compounds such as thiosulfates, thioureas, thiazoles, rhodanines, etc.

Reduction sensitizing agents which can be used include stannous salts, amines, formamidinesulfinic acid, silane compounds, etc.

For the purpose of increasing sensitivity, the photographic light-sensitive materials of the present invention can contain sensitizing dyes, such as cyanine dyes, merocyanine dyes, etc., as described, for example, in U.S. Pat. No. 4,243,739.

For example, in the case of using cationic dyes, cyanine, hemicyanine, and rhodacyanine dyes are preferably used. Particularly preferred are the following dyes.

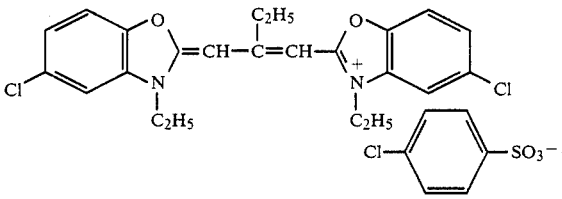

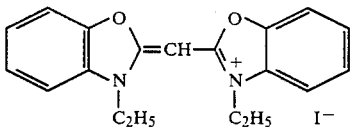

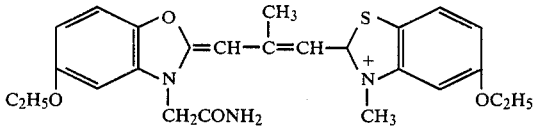

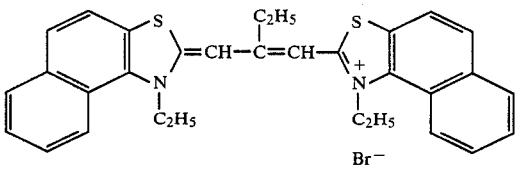

These sensitizing dyes may be used either alone or in combination with each other. Combinations of sensitizing dyes are often used particularly for the purpose of supersensitization. The photographic emulsions may contain, in addition to the sensitizing dyes, a dye which has per se no spectrally sensitizing effect or a substance which does not substantially absorb visible light, but said dye or substance exhibiting supersensitizing effect.

Specific examples of useful sensitizing dyes, combinations of dyes for supersensitization, and substances exhibiting supersensitizing effect are disclosed, for example, in *Research Disclosure, Vol.* 176, RD No. 17643, page 23, (December, 1979), IV-J.

The photographic light-sensitive materials according to the present invention can contain various compounds known as antifoggants or stabilizers for the purpose of preventing fog during preparation, preservation, or photographic processing of the photographic materials, or for stabilizing photographic performances. Examples of such compounds include azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds, e.g., oxazolinethione, etc.; azaindenes, e.g., triazaindenes, tetraazaindenes (especially 4-hydroxy-substituted (1,3,3a,7)tetraazaindenes), pentaazaindenes, etc,; benzenethiosulfonic acid; benzenesulfinic acid; benzenesulfonic acid amide; and the like. Preferred among them are benzotriazoles, e.g., 5-methylbenzotriazole and nitroindazoles, e.g., 5-nitroindazole. These compounds may also be incorporated in a processing solution.

The photographic emulsion layers or a light-insensitive hydrophilic colloid layers of the photographic light-sensitive materials of the present invention may contain an organic or inorganic hardener, such as a chromium salt, e.g., chrominum alum, chromium acetate, etc.; an aldehyde, e.g., formaldehyde, glyoxal, glutaraldehyde, etc.; an N-methylol compound, e.g., dimethylolurea, methyloldimethylhydantoin, etc.; dioxane derivatives, e.g., 2,3-dihydroxydioxane, etc.; an active vinyl compound, e.g., 1,3,5-triacryloyl-hexahydro-s-triazine, 1,3-vinylsulfonyl-2-propanol, etc.; an active halogen compound, e.g., 2,4-dichloro-6-hydroxy-s-triazine, etc.; a mucohalogenic acid, e.g., mucochloric acid, mucophenoxychloric acid, etc.; epoxy compounds, e.g., tetramethylene glycol diglycidyl ether, etc.; isocyanate compounds, e.g., hexamethylene diisocyanate, etc.; and the like, either alone or in combinations thereof.

The photographic emulsion layers or the light-insensitive hydrophilic colloid layers of the photographic light-sensitive materials of the present invention may further contain a large variety of surface active agent for various purposes, for example, as coating aids, as antistatic agents, for improvement of sliding properties, an emulsification or dispersion, for prevention of adhesion, for improvement of photographic characteristics (e.g., development acceleration, increasing contrast, increasing sensitivity, etc.), and the like.

Examples of the surface active agents to be used in the present invention include nonionic surface active agents such as saponin (steroid type), alkylene oxide derivatives, e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone, etc., glycidol derivatives, e.g., alkenylsuccinic polyglycerides, alkylphenyl polyglycerides, etc., fatty acid esters of polyhydric alcohols, alkyl esters of sugars, and the like; anionic surface active agents containing acidic groups, e.g., a carboxyl group, a sulfo group, a phospho group, a sulfuric ester group, a phosphoric ester group, etc., such as alkylcarboxylates, alkylsulfonates, alkylbenzenesulfonates, alkylnaphthalenesulfonates, alkylsulfates, alkylphosphates, N-acyl-N-alkyltaurins, sulfosuccinates, sulfoalkylpolyoxyethylene alkylphenyl ethers, polyoxyethylene alkylphosphates, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Of these compounds, polyalkylene oxides having a molecular weight of 600 or more, as described in U.S. Pat. No. 4,221,857, are preferably used in the present invention. Also, for the purpose of increasing dimensional stability, latexes of polymers such as polyalkyl acrylate can be incorporated.

In obtaining photographic characteristics of super high contrast and high sensitivity using the silver halide light-sensitive material of the present invention, it is not necessary to use the conventional infectious developers or high alkali developers having a pH of about 13 as described in U.S. Pat. No. 2,419,975; and a stable developer can be used.

That is, the silver halide photographic material of the present invention can provide negative images of sufficiently high contrast having a gamma ($\gamma$) of more than 10 when developed with a developer containing at least 0.15 mol/liter (developer), and preferably from 0.2 to 0.8 mol/liter (developer), of sulfite ion and having a pH of from 10.5 to 12.3, particularly from 11.0 to 12.0.

There are no special limitations to developing agents which can be used in the present invention. For example, dihydroxybenzenes such as hydroquinone, 3-pyrazolidones such as 1-phenyl-3-pyrazolidone and 4,4-dimethyl-1-phenyl-3-pyrazolidone, aminophenols such as N-methyl-p-aminophenol, and the like can be used alone or in combination with each other.

The silver halide light-sensitive material of the present invention is suitable particularly for processing with a developer containing dihydroxybenzenes as the main developing agent and 3-pyrazolidones or aminophenols as the auxiliary developing agent. The concentration of dihydroxybenzenes is preferably from 0.05 to 0.5 mol/liter (developer), and particularly preferably from 0.15 to 0.45 mol/liter (developer). The concentration of 3-pyrazolidones or aminophenols is preferably not more than 0.06 mol/liter (developer), and particularly preferably from $0.5\times10^{-3}$ to 0.02 mol/liter (developer).

As described in U.S. Pat. No. 4,269,929, the developing speed can be increased and the developing time can be shortened by adding amines to the developer.

The developer can further contain a pH buffer, e.g., the sulfites, carbonates, borates, and phosphates of alkali metals, a development inhibitor, e.g., bromides, iodides, and organic antifoggants (particularly preferably nitroindazoles or benzotriazoles), antifoggants and the like. If desired, the developer can contain a hard water-softening agent, a dissolving aid, a color tone adjustor, a development accelerator, a surface active agent (particularly preferably the above-described polyalkylene oxides), a defoaming agent, a hardener, an agent to prevent silver contamination of films (e.g., 2-mercaptobenzimidazolesulfonic acids), and the like.

As a fixing agent, those having commonly used compositions can be used. As a fixing agent, in addition to thiosulfuric acid salts and thiocyanic acid salts, organic sulfur compounds which are known to be effective as a fixing agent can be used. The fixing agent may contain water-soluble aluminum salts and the like as the hardener.

In the present invention, the processing temperature is usually chosen within the range of from 18° C. to 50° C.

The photographic processing is preferably processed by using an automatic developing machine. In accordance with the present invention, even if the total processing time from the introduction of the photographic light-sensitive material into the automatic developing machine to the withdrawal therefrom is set at from 90 to 120 seconds, photographic characteristics of sufficiently high contrast and negative gradation can be obtained.

The present invention is described in greater detail with reference to the following examples.

In the examples, a developer having the following formulation was used.

| Basic Formulation of Developer | |
|---|---|
| Hydroquinone | 35.0 g |
| N—methyl-p-aminophenol ½ sulfate | 0.8 g |
| Sodium hydroxide | 13.0 g |
| Potassium tertiary phosphate | 74.0 g |
| Potassium sulfite | 90.0 g |
| Disodium ethylenediaminetetraacetate | 1.0 g |
| Potassium bromide | 4.0 g |
| 5-Methylbenzotriazole | 0.6 g |
| 3-Diethylamino-1,2-propanediol | 15.0 g |
| Water to make | 1 liter (pH = 11.5) |

COMPARATIVE EXAMPLE 1

To an aqueous gelatin solution maintained at 50° C. were added an aqueous silver nitrate solution, an aqueous potassium iodide solution and an aqueous potassium bromide solution at the same time in the presence of $4\times10^{-7}$ mol per mol of silver of iridium (III) potassium hexachloride and ammonia over 60 minutes. During this period, pAg was maintained at 7.8. In this way, a cubic monodisperse emulsion having an average particle diameter of 0.25 $\mu$m and an average silver iodide content of 1 mol% was prepared. To this silver iodobromide emulsion were added a 5,5'-dichloro-9-ethyl-3,3'-bis(3-sulfopropyl)oxacarbocyanine sodium salt as a sensitizing dye and as stabilizers, 4-hydroxy-6-methyl-1,3,3a,7-tetraazaindene, a dispersion of polyethyl acrylate, polyethylene glycol, 1,3-vinylsulfonyl-2-propanol, and Compound I-9. The resulting mixture was coated on a polyethylene terephthalate base in a silver amount of 3.4 g/m$^2$ to prepare a Comparative Example 1 (Sample 1).

COMPARATIVE EXAMPLE 2

Comparative Example 2 (Sample 2) was prepared in the same manner as in Comparative Example 1 except that an acid polymer represented by the formula below was further added in an amount of 0.5 g/m$^2$.

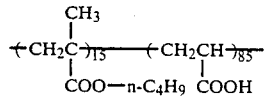

EXAMPLE 1

The procedure of Comparative Example 2 was repeated except that the acid polymer of Comparative Example 2 was replaced with the following acid polymer/tertiary amine salts to prepare Samples 1a, 1b, 1c, 1d, and 1e. The amount of each salt used was such that the amount of the acid polymer was 0.5 g/m$^2$.

1a: 40 mol% triethanolamine salt of

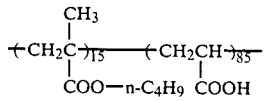

1b: 20 mol% dihydroxyethyl-n-butylamine salt of the above polymer

1c: 30 mol% dihydroxyethyl-ethylamine salt of the above polymer

1d: 60 mol% 1-hydroxyethyl-piperazine salt of the above polymer

1e: 40 mol% N-hydroxyethylmorpholine salt of the above polymer

Each sample was exposed and developed, and measured for photographic characteristics. The results are shown in Table 1.

TABLE 1

| Sample No. | Evaluation of Black Spots(1) | Photographic Performance(2) Sensitivity (Relative Value) | gamma |
|---|---|---|---|
| 1* | 28 | 0 (basis) | 17 |
| 2* | 4 | −0.32 | 17 |
| 1a | 4 | −0.05 | 19 |
| 1b | 5 | −0.15 | 20 |
| 1c | 4 | −0.09 | 16 |
| 1d | 6 | −0.06 | 16 |
| 1e | 5 | −0.05 | 17 |

*Comparative examples (1)An area with a diameter of about 4 mm was enlarged to 25 times the original area with a microscope. The number of black spots in the enlarged area was counted. Based on the number of black spots, the evaluation was performed. As the value is smaller, the evaluation of black spots is better.

(2)The sensitivity is indicated by a relative value of an exposure amount (E) to provide a density of 1.5 with that of Comparative Example 1 as a base and indicated in terms of Δlog E. A negative value indicates that the sensitivity is relatively low.

As can be seen from Table 1, in Comparative Example 2 wherein the acid polymer was added, the black spots were improved but the sensitivity was reduced. On the other hand, in Samples 1a to 1e of the present invention wherein the tertiary amine salts were used, a reduction of sensitivity was small and the black spots were improved.

EXAMPLE 2

The procedure of Comparative Example 2 was repeated except that the acid polymer Comparative Example 2 was replaced with the following acid polymer salts.

2a: 40 mol% triethanolamine salt of

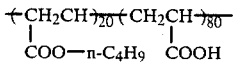

2b: 40 mol% triethanolamine salt of

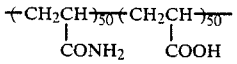

2c: 40 mol% triethanolamine salt of

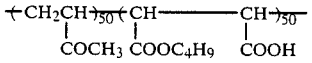

2d: 40 mol% triethanolamine salt of an aqueous latex

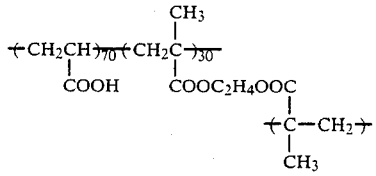

2e: 40 mol% triethanolamine salt of an aqueous latex

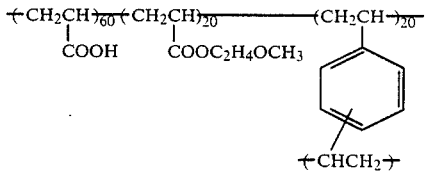

Each sample was exposed and developed, and measured for photographic properties in the same manner as in Example 1. The results are shown in Table 2.

TABLE 2

| Sample No. | Evaluation of Black Spots | Photographic Performance Sensitivity (Relative Value) | gamma |
|---|---|---|---|
| 2* | 4 | −0.32 | 17 |
| 2a | 2 | −0.10 | 23 |
| 2b | 6 | −0.07 | 16 |
| 2c | 4 | −0.10 | 19 |
| 2d | 8 | −0.15 | 17 |
| 2e | 7 | −0.10 | 17 |

*Comparative example

As can be seen from Table 2, the samples of the present invention show decreased formation of black spots and further have a small decrease of sensitivity, while maintaining or improving high gamma values.

While the invention has been described in detail and with reference to specific embodiments thereof, it will be apparent to one skilled in the art that various changes and modifications can be made therein without departing from the spirit and scope thereof.

What is claimed is:

1. A negative type silver halide photographic material comprising a support, at least one silver halide emulsion layer on the support, and at least one light-insensitive hydrophilic colloid layer on the support, wherein said emulsion layer or light-insensitive hydrophilic colloid layer contains a hydrazine derivative, and further contains a tertiary amine salt of an acid polymer.

2. A negative type silver halide photographic material as in claim 1, wherein said acid polymer is a compound represented by formula (IIa) or formula (IIb)

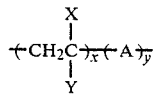

(IIa)

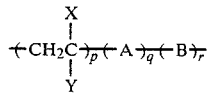

(IIb)

wherein

X represents a hydrogen atom, a halogen atom, a cyano group, or a substituted or unsubstituted alkyl group;

Y represents a hydrogen atom, a halogen atom, cyano group, a substituted or unsubstituted alkyl group, a group $$-\underset{\underset{O}{\|}}{C}-O-R^{11}$$

(wherein $R^{11}$ represents a substituted or unsubstituted alkyl group having 2 or more carbon atoms, or a substituted or unsubstituted aryl group), a group $$-O-\underset{\underset{O}{\|}}{C}-R^{12}$$

(wherein $R^{12}$ represents a substituted or unsubstituted alkyl group, or a substituted or unsubstituted aryl group), a group $$-\underset{\underset{O}{\|}}{C}-\overset{\overset{R^{13}}{|}}{N}-R^{14}, \text{ a group } -\overset{\overset{R^{13}}{|}}{N}-\underset{\underset{O}{\|}}{C}-R^{14}$$

(wherein $R^{13}$ and $R^{14}$ each represents a hydrogen atom, a substituted or unsubstituted alkyl group, or a substituted or unsubstituted aryl group), or a substituted or unsubstituted aryl group;

A represents a repeating unit derived from an ethylenically unsaturated monocarboxylic acid or monocarboxylic acid salt capable of copolymerizing with an ethylenically unsaturated monomer;

B represents a polyfunctional crosslinking agent; and x, y, p, q, and r each represents the mol percentage of the respective components with which they are associated in formulae (IIa) and (IIb) and have the following relationship:

$x+y=100$, $0 \leqq x \leqq 60$, $40 \leqq y \leqq 100$, $p+q+r=100$, $0 \leqq p \leqq 60$, $30 \leqq q \leqq 100$, $0 \leqq r \leqq 40$.

3. A negative type silver halide photographic material as in claim 1, wherein said tertiary amine is a compound represented by formula (IV)

$$R_{21}-\underset{\underset{R_{22}}{|}}{N}-R_{23} \qquad \text{(IV)}$$

wherein $R_{21}$, $R_{22}$, and $R_{23}$ are each selected from an alkyl group having 6 or less carbon atoms;

a substituted alkyl group;

an aryl group having from 6 to 12 carbon atoms;

a substituted aryl group; and a 5- or 6-membered ring formed by N and two of $R_{21}$, $R_{22}$, and $R_{23}$.

4. A negative type silver halide photographic material as in claim 3, wherein at least one of $R_{21}$, $R_{22}$, and $R_{23}$ represents a hydroxy ethyl group.

5. A negative type silver halide photographic material as in claim 1, wherein the tertiary amine salt of the acid polymer is present in an amount from 10 mg/m$^2$ to 10 g/m$^2$, and the amount of acidic groups thereof is from 0.1 mmol/m$^2$ to 100 mmol/m$^2$.

6. A negative type silver halide photographic material as in claim 1, wherein the tertiary amine salt of the acid polymer is present in an amount from 20 mg/m$^2$ to 3 g/m$^2$, and the amount of acidic groups thereof is from 0.5 mmol/m$^2$ to 50 mmol/m$^2$.

7. A method for forming a super high contrast negative image, which comprises imagewise exposing a negative type silver halide photographic material comprising a support, at least one silver halide emulsion layer on the support, and at least one hydrophilic colloid layer, wherein said emulsion layer or light-insensitive hydrophilic colloid layer contains a hydrazine derivative, and further contains a tertiary amine of an acid polymer, and then developing the photographic material with a developer containing at least 0.15 mol/liter of sulfite ion and having a pH of from 10.5 to 12.3.

8. A method for forming a super high contrast negative image as in claim 7, wherein said acid polymer is a compound represented by formula (IIa) or formula (IIb)

$$\left(CH_2\underset{\underset{Y}{|}}{\overset{\overset{X}{|}}{C}}\right)_x\left(A\right)_y \qquad \text{(IIa)}$$

$$\left(CH_2\underset{\underset{Y}{|}}{\overset{\overset{X}{|}}{C}}\right)_p\left(A\right)_q\left(B\right)_r \qquad \text{(IIb)}$$

wherein

X represents a hydrogen atom, a halogen atom, a cyano group, or a substituted or unsubstituted alkyl group;

Y represents a hydrogen atom, a halogen atom, cyano group, a substituted or unsubstituted alkyl group, a group $$-\underset{\underset{O}{\|}}{C}-O-R^{11}$$

(wherein $R^{11}$ represents a substituted or unsubstituted alkyl group having 2 or more carbon atoms, or a substituted or unsubstituted aryl group), a group $$-O-\underset{\underset{O}{\|}}{C}-R^{12}$$

(wherein $R^{12}$ represents a substituted or unsubstituted alkyl group, or a substituted or unsubstituted aryl group), a group $$-\underset{\underset{O}{\|}}{C}-\overset{\overset{R^{13}}{|}}{N}-R^{14}, \text{ a group } -\overset{\overset{R^{13}}{|}}{N}-\underset{\underset{O}{\|}}{C}-R^{14}$$

(wherein $R^{13}$ and $R^{14}$ each represents a hydrogen atom, a substituted or unsubstituted alkyl group, or a substituted or unsubstituted aryl group), or a substituted or unsubstituted aryl group;

A represents a repeating unit derived from an ethylenically unsaturated monocarboxylic acid or monocarboxylic acid salt capable of copolymerizing with an ethylenically unsaturated monomer;

B represents a polyfunctional crosslinking agent; and x, y, p, q, and r each represents the mol percentage of the respective components with which they are associated in formulae (IIa) and (IIb) and have the following relationship:

$x+y=100$, $0 \leqq x \leqq 60$, $40 \leqq y \leqq 100$, $p+q+r=100$, $0 \leqq p \leqq 60$, $30 \leqq q \leqq 100$, $0 \leqq r \leqq 40$.

9. A method for forming a super high contrast negative image as in claim 7, wherein said tertiary amine is a compound represented by formula (IV)

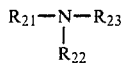

(IV)

wherein $R_{21}$, $R_{22}$, and $R_{23}$ are each selected from an alkyl group having 6 or less carbon atoms;

a substituted alkyl group;

an aryl group having from 6 to 12 carbon atoms;

a substituted aryl group; and a 5- or 6-membered ring formed by N and two of $R_{21}$, $R_{22}$, and $R_{23}$.

10. A method for forming a super high contrast negative image as in claim 9, wherein at least one of $R_{21}$, $R_{22}$, and $R_{23}$ represents a hydroxy ethyl group.

11. A method for forming a super high contrast negative image as in claim 7, wherein the tertiary amine salt of the acid polymer is present in an amount from 10 $mg/m^2$ to 10 $g/m^2$, and the amount of acidic groups thereof is from 0.1 $mmol/m^2$ to 100 $mmol/m^2$.

12. A method for forming a super high contrast negative image as in claim 7, wherein the tertiary amine salt of the acid polymer is present in an amount from 20 $mg/m^2$ to 3 $g/m^2$, and the amount of acidic groups thereof is from 0.5 $mmol/m^2$ to 50 $mmol/m^2$.

* * * * *